US007810707B2

(12) United States Patent
Little

(10) Patent No.: US 7,810,707 B2
(45) Date of Patent: Oct. 12, 2010

(54) MATERIALS FOR AND METHOD FOR MANUFACTURING CONTAINER WITH END SUPPORTS AND RESULTING CONTAINER

(75) Inventor: Troy Little, Thomasville, PA (US)

(73) Assignee: York Container Company, York, PA (US)

( * ) Notice: Subject to any disclaimer, the term of this patent is extended or adjusted under 35 U.S.C. 154(b) by 109 days.

(21) Appl. No.: 12/268,594

(22) Filed: Nov. 11, 2008

(65) Prior Publication Data

US 2010/0120594 A1 May 13, 2010

(51) Int. Cl.
*B65D 5/50* (2006.01)
*B65D 5/58* (2006.01)
*B31B 7/00* (2006.01)

(52) U.S. Cl. ..... 229/122.32; 229/164; 229/199; 493/89; 493/100; 493/907

(58) Field of Classification Search ..... 229/122.32, 229/164, 199, 120.23, 120.31; 206/427, 206/784; 493/89, 90, 92, 100, 907, 912
See application file for complete search history.

(56) References Cited

U.S. PATENT DOCUMENTS

| | | | | | |
|---|---|---|---|---|---|
| 499,654 | A * | 6/1893 | Clark | ..... | 229/122.32 |
| 959,261 | A * | 5/1910 | Reber | ..... | 229/122.32 |
| 2,766,923 | A * | 10/1956 | D Esposito | ..... | 229/199 |
| 3,034,698 | A | 5/1962 | Forrer | | |
| 3,397,831 | A | 8/1968 | Adams | | |
| 4,056,223 | A | 11/1977 | Williams | | |
| 4,068,796 | A | 1/1978 | Kullman, Jr. | | |
| 4,874,125 | A | 10/1989 | Bates | | |
| 5,375,715 | A | 12/1994 | Serre et al. | | |
| 5,400,955 | A | 3/1995 | Coalier et al. | | |
| 5,505,368 | A | 4/1996 | Kanter et al. | | |
| 5,947,292 | A * | 9/1999 | Chelfi | ..... | 229/199 |
| 6,138,904 | A * | 10/2000 | Baird et al. | ..... | 229/199 |
| 6,158,653 | A | 12/2000 | Kanter et al. | | |
| 6,325,282 | B1 | 12/2001 | Kanter et al. | | |
| 6,712,214 | B1 * | 3/2004 | Wintermute et al. | ..... | 229/199 |
| 6,719,191 | B1 * | 4/2004 | Christensen et al. | ... | 229/122.26 |
| 6,817,514 | B2 | 11/2004 | Kanter et al. | | |
| 6,868,968 | B1 * | 3/2005 | Casanovas | ..... | 229/164 |
| 6,874,679 | B2 | 4/2005 | Tibbles et al. | | |
| 2006/0124712 | A1 * | 6/2006 | Weimer, Jr. | ..... | 229/164 |
| 2006/0196920 | A1 * | 9/2006 | Moen | ..... | 229/164 |
| 2010/0083618 | A1 * | 4/2010 | Little | ..... | 229/122.32 |

FOREIGN PATENT DOCUMENTS

| | | | | |
|---|---|---|---|---|
| FR | 2641758 A1 * | 7/1990 | ..... | 229/199 |

* cited by examiner

*Primary Examiner*—Gary E Elkins
(74) *Attorney, Agent, or Firm*—Barnes & Thornburg LLP

(57) ABSTRACT

In accordance with the invention, a method of manufacturing containers such as shipping, display and display ready packaging, for example, and resulting containers and associated preassemblies and blanks are provided, which, when utilized, result in preassemblies that include end supports that provide increased stacking strength and are easily and quickly assembled into fully assembled containers.

18 Claims, 10 Drawing Sheets

MATERIALS FOR AND METHOD FOR MANUFACTURING CONTAINER WITH END SUPPORTS AND RESULTING CONTAINER

The invention relates in general to the manufacture of containers that may be readily used to ship and/or display contents following delivery of the container, as specified in the independent claims.

BACKGROUND OF THE INVENTION

Various containers are conventionally provided as packaging for shipping or for display of product in a retail environment to prospective customers. As is conventionally known in the industry, such containers can be transported to manufacturing and/or retail environments for use in shipping or display in knock-down form, i.e., flattened but otherwise being glued, stapled or otherwise secured together, such that they are already substantially pre-assembled. Such knock-down form containers are also referred to as preassemblies. In such a "knockdown" state (i.e., knocked down or not set-up), personnel or equipment used in the final assembly of the product container need only open the sides and or ends of the container and affix the package bottom wall into its assembled condition. As a result, such container assembly may be performed such that the product can be placed into a resulting assembled container for shipping or as a display package.

Conventionally, it has been deemed advantageous at times to stack a plurality of such containers, one on top of the other for the purposes of storage, transport to a retail or manufacturing environment or during display in the retail environment. In these uses, it is necessary that the containers stacked above the bottom-most package are amply supported. Additionally, it is useful if the design of the containers is such that a stack of such containers, when filled with product, will not collapse.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with illustrated embodiments, a method of manufacturing containers and resulting containers and associated preassemblies and blanks are provided, which, when utilized, result in containers having an interior formed by a primary blank serving as an exterior of the container, the interior including a plurality of end supports, each of which being formed by a supplementary blank adhered to the primary blank at opposing ends of the container interior; the plurality of end supports are each formed as part of the set up or final assembly of exterior of the container and each may be shaped like a "V," thereby providing a median interior region of the container having a reduced width relative to the corresponding overall width of the container interior.

Additionally, in accordance with illustrated embodiments, the plurality of end supports are each formed by coupling of the primary and supplementary blanks at a side panel of the primary blank.

The illustrated embodiments of the invention have particular utility when used for the manufacture of preassemblies and associated containers that are flat bottomed tray type containers.

These illustrated embodiments are achieved by a combination of features recited in the independent claims. Accordingly, dependent claims prescribe further detailed implementations of the present invention.

BRIEF DESCRIPTION OF THE DRAWINGS

Various embodiments are described herein, by way of example only, with reference to the accompanying drawings. With specific reference now to the drawings, it should be understood that the particulars shown are by way of example and for purposes of discussion of illustrated embodiments only, and are presented in order to provide what is believed to be a useful and readily understood description of the principles and concepts of the invention. In this regard, no attempt is made to show structural details of the invention in more detail than is necessary for a fundamental understanding of the invention, the description taken with the drawings making apparent to those skilled in the art how the several forms of the invention may be embodied in practice.

Accordingly, a more complete understanding of the present invention and the utility thereof may be acquired by referring to the following description in consideration of the accompanying drawings, in which like reference numbers indicate like features, and wherein.

DETAILED DESCRIPTION OF THE INVENTION

Figure 1:
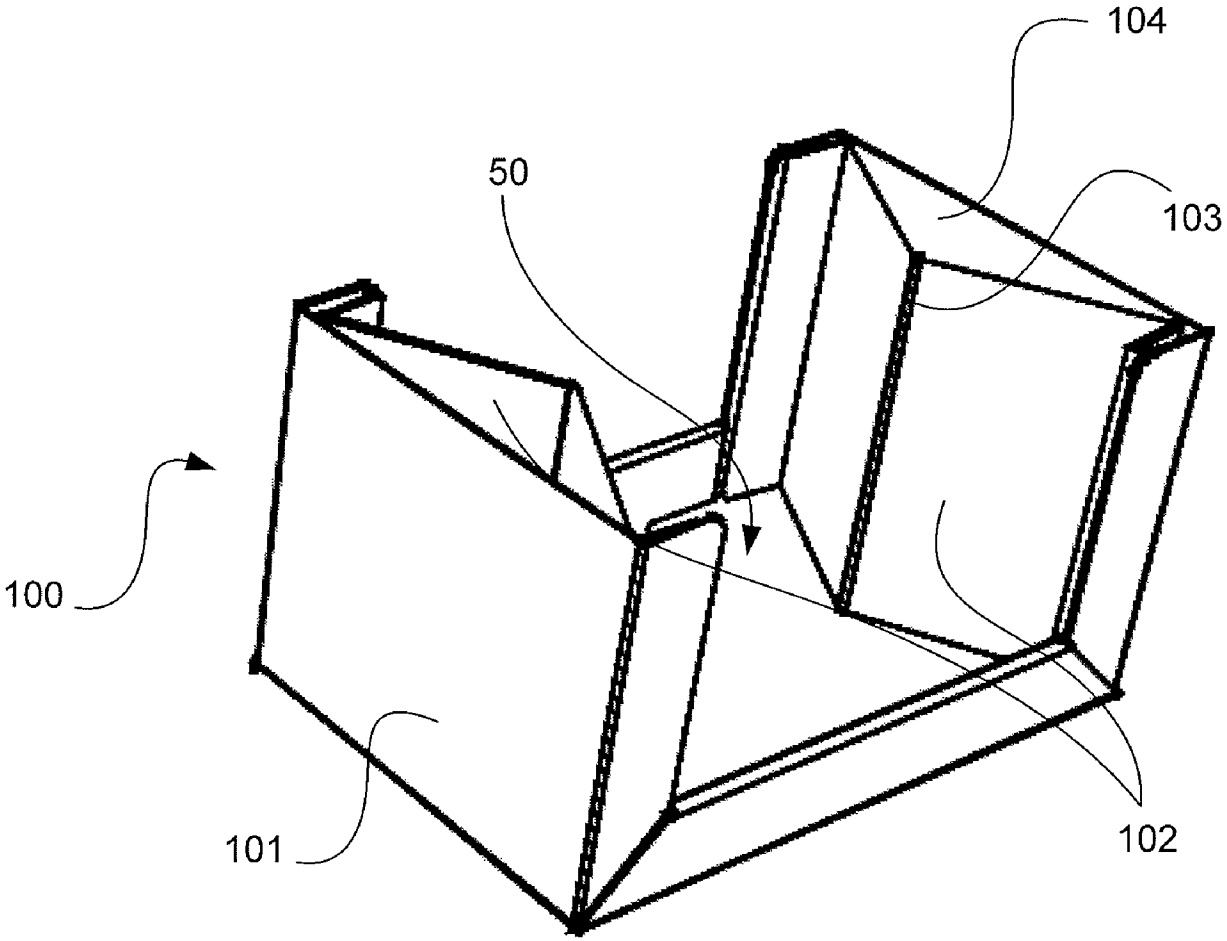
FIG. 1 illustrates a side perspective view of a container manufactured in accordance with an illustrated embodiment.

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

Shipping, display and dual-use containers (e.g., those containers that may be used for both shipping and display), often suffer from a conventional problem in that product in the containers can shift during shipping or during display. This is a particular problem when product is susceptible to shifting, slipping, sliding or otherwise moving upon itself. It is particularly useful to inhibit such movement if, for example, the product is fragile or the product is at risk of moving out of an aperture in the container.

This is also a particular problem for dual-use containers that may be used to ship product and subsequently display product following removal of a portion of the container material. In such dual-use containers, one or more panels may be removable following delivery of the product to a retail environment; the removal of the panel(s) provides one or more apertures that facilitate viewing of and access to the product in the container. In such containers, a problem can occur in that product may have shifted during transport of the container and the product is at risk of falling out of the container aperture during display. Such a problem is particularly significant when product is heavy and/or slippery, prone to movement and/or included in packaging that is deformable. For example, when product is relatively small, e.g., candy, and is included in large plastic bags that may be stacked on one another within the container, there is a risk that such bags may slide relative to one another either during transport or during subsequent display in a retail environment. Thus, when a container aperture is opened, the product bags may slip relative to each other such that they must be restacked in order to allow display of the product bags in the container.

Further, as explained above, it is useful to be able to stack a plurality of containers one on top of the other for the purposes of transport to or from a manufacturing or retail environment or during storage and/or display in a manufacturing or retail environment. This ability (also known as "stackability") requires that containers stacked above the bottom-most package are amply supported and also requires that a stack of a number of such containers, when filled with product, will not collapse.

Conventionally, there are various container designs that provide increased stackability by including, for example, types of corner supports or auxiliary supports that utilize additional material and components to increase the vertical stability of the container. However, the number of separate actions needed to assemble such container designs (conventionally referred to as the number of "touches" required for assembly) varies greatly and may be significant; thus, a container requiring complex assembly requires a greater number of touches than a container requiring relatively simple assembly.

The skill level and time required for assembling such containers from a knock-down form varies depending on the required number of touches for assembling the container. The time required for assembling conventional container including such auxiliary supports of some sort or another may be somewhat lengthy as assembly of a container may require a number of separate actions to be performed by the final container assembler (regardless of whether the final assembly is performed by a human or automated or semi-automated machinery).

Another problem with such conventional, stackable container designs is the increased height, length, width and weight of such containers due to the added material provided for the auxiliary supports. Therefore, although the use of such stackable containers is useful, the increased time for final assembly and increased dimensions and weight of the containers are deficiencies of conventional designs.

Thus, there is a need for a stackable container design that can deter movement of product packaging therein and provides some type of auxiliary support that results in reduced affect on the overall dimensions and weight of the container, while both reducing the amount of material used in the container and reducing the number of touches required for final assembly of the container.

With this understanding in mind, a description of various invention embodiments is now provided.

According to as least one illustrated embodiment, there is provided equipment configured to manufacture containers, e.g., for shipment and/or display of product (as well as corresponding container preassemblies and blanks) that result in containers having an interior formed by a primary blank serving as an exterior of the container, the interior including a plurality of end supports each formed by a supplementary blank adhered to the primary blank at opposing ends of the container interior. In at least one illustrated embodiment, the end supports each are V-shaped and are adhered to the primary blank in such a way that a median area of the container interior has a decreased width (between the end walls) relative to the overall width of the container interior (between the end walls). Further, in accordance with at least one embodiment, the plurality of end supports are formed as part of the set up or final assembly of exterior of the container.

Understanding of the manufacturing of a container, blanks and/or preassemblies in accordance with embodiments may best be understood by first reviewing an illustration of a manufactured container provided in accordance with one illustrated embodiment. As illustrated in FIG. 1, one example of such a container 100 may be a flat bottomed tray style container, which may include a main compartment 50 defined between a plurality of end supports formed by a corresponding plurality of supplementary blanks 102 and included in an interior space of a primary blank 101 following assembly. These end supports may be formed by the coupling of the supplementary blanks 102 to locations on the primary blank 101, as explained herein. Additionally, as part of preassembly manufacture for a preassembly for container 100, the supplementary blanks 102 may be adhered to the primary blank 101 as explained in connection with FIGS. 5-8 to provide for improved ease of final assembly for the container 100.

As shown in FIG. 1, the end supports may be V-shaped including an apex fold line 103 and resulting in an air cell 104 provided between the fold line 103 and the corresponding end panel of the primary blank 101. Such a container 100 may be used for various purposes including shipping and/or display on a display floor along with other such containers in a stack. However, it should be understood that the manufactured container may be any type of container including, for example, any carton, package, box, etc., of any suitable type; accordingly, the actual configurations of the primary blank 101 and the interrelationship with the supplementary blanks 102 may change without departing from the scope of the embodiments. Thus, in accordance with illustrated embodiments, a method is provided of manufacturing containers and resulting containers 100 and associated preassemblies (the combination of 101, 102) and blanks 101, 102, which, when utilized, result in containers 100 that include supplementary blanks 102 that each provide an end support that serves as a mechanism for improving the stackability of the container 100, whereby the container 100 may be configured to bare larger amounts of force (e.g., weight) from a top direction.

Figure 2:
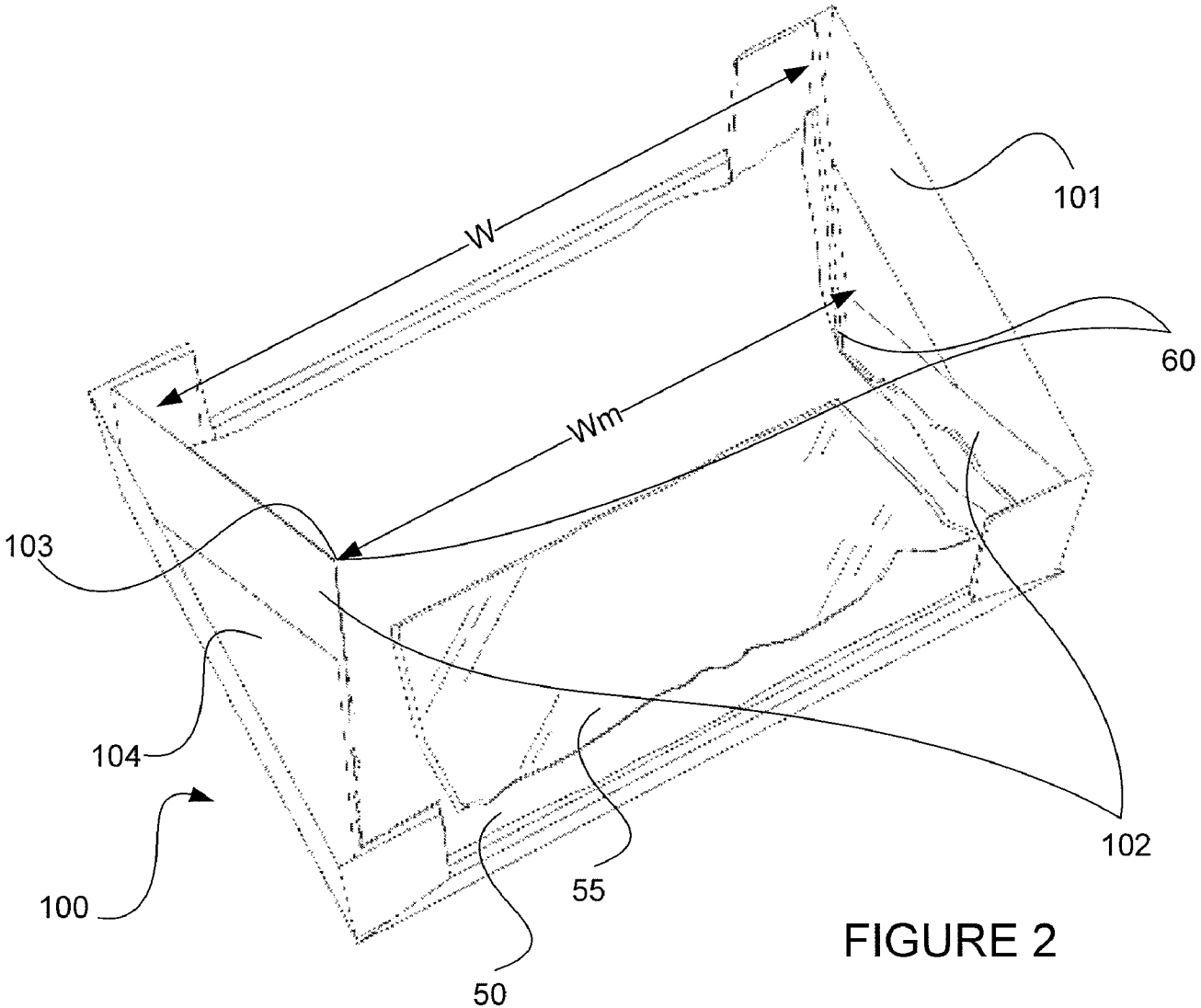
FIG. 2 illustrates a second side perspective view of a container manufactured in accordance with an illustrated embodiment with product loaded in the container.

Further, in accordance with the illustrated embodiment, the conventional need to deter shifting product packaging is also addressed by the V-Shaped end supports. More specifically, as illustrated in FIG. 2, the apex fold line 103 provided on each of the end supports results in a median region having a decreased width $W_m$ relative to the overall width W of the interior of the container 100. Because of the weight of a product package 50, placing product packaging 50 in the interior of the contain 100 such that package mid-side points 60 are compressed within the decreased width $W_m$ region deters movement of the product packaging 50. Thus, product packaging 50 movement can be hindered during shipping and also during subsequent display when one or more apertures are opened in the container. Furthermore, if the product packaging 50 includes an optional product window 55 (for viewing the product inside the packaging 50), the positioning of the packaging 50 provided by the decreased width region $W_m$ helps ensure consistent and/or aesthetic placement of the product window 55.

Based on the illustrated examples of container designs provided with end supports as disclosed herein, it should be appreciated that the incorporation of the end supports also increases stackability of the resulting containers without requiring a lengthier time period for final assembly and without a need for assemblers (either human or automated or semi-automated equipment) to have superior capabilities. This is because, as explained herein, the majority if not all of manipulation of the preassembly to form the end supports is already performed as part of the final assembly of the primary blank as the exterior of the container. As a result, additional touches needed to provide the end supports is reduced or eliminated relative to what would be conventionally required for installing or assembling conventional auxiliary stacking supports.

Further, the illustrated examples of containers designs provide end supports with significantly less material than is conventionally required for similar conventional containers with auxiliary stacking supports. For example, the square footage of material incorporated in container designs utilizing the inventive concept may be reduced significantly. This reduction in material results in a reduction in the container weight and resources expended to produce the container, while still providing improved container strength.

Figure 3:
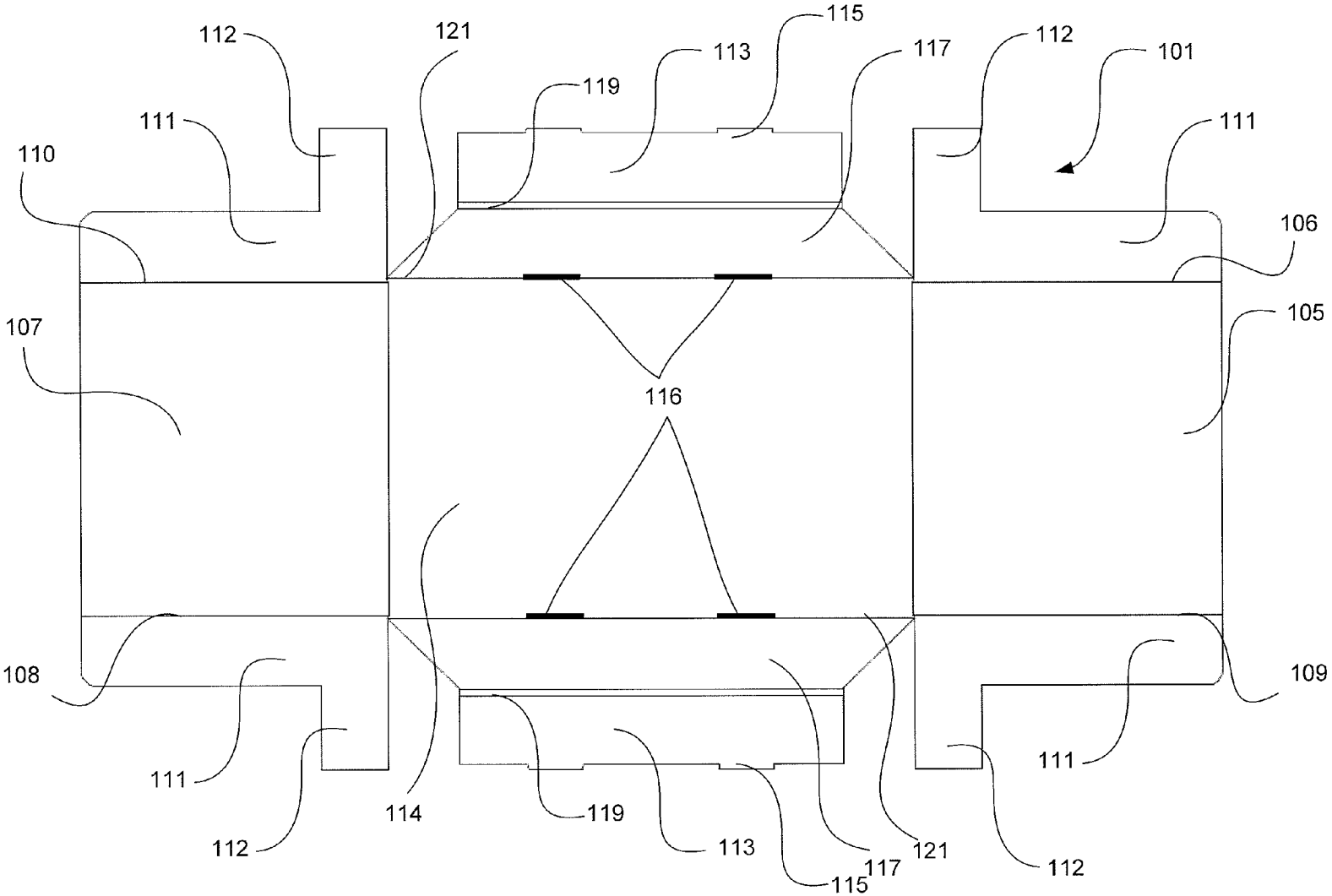
FIG. 3 illustrates an example of an assembled primary blank used in manufacturing the container of the type illustrated in FIG. 1.

FIG. 3 illustrates an example of a primary blank 101, which may be thought of as a conventional tray type as the one illustrated in FIG. 1. The knockdown of the container 100 of FIG. 1 is manufactured by joining the primary blank 101 with supplementary blanks 102 (which may be thought of as pads) an example of which being illustrated in FIG. 4, as explained herein. The primary blank 101 illustrated in FIG. 3 corresponds to an exterior of the container 100 illustrated in FIGS. 1 and 2. Likewise, the container 100 also includes supplementary blank 102 illustrated separately in FIG. 4 and in conjunction with primary blank 101 in FIGS. 5-8.

As shown in FIG. 3, the primary blank 101 includes a first end panel 105 and second end panel 107 coupled together via a bottom panel 114. Both the first and second end panels 105, 107 are each connected to a pair of side panels 111. Each side panel 111 includes a region 112 configured to cooperate with the first and second rollover panels 113, 117 during final assembly of the container (as explained herein). Two pairs of first and second rollover panels 113, 117 are included in the primary blank 101 and attached on each side of the bottom panel 114. The first and second rollover panels 113, 117 are coupled together along a fold line 119 and cooperate to form front and rear sides of the container 100 following final assembly. More specifically, as explained herein with connection to FIG. 8, the first and second rollover panels 113, 117 are folded towards each other along fold line 119 and folded relative to the bottom panel 114 along fold line 121 during final assembly thereby trapping region 112 of the side panel 111 therebetween. Subsequently, tabs 115 included on the first rollover panel 113 are inserted in corresponding slots 116 provided on the fold line 121 between the bottom panel 114 and the second rollover panel 117.

Figure 4:
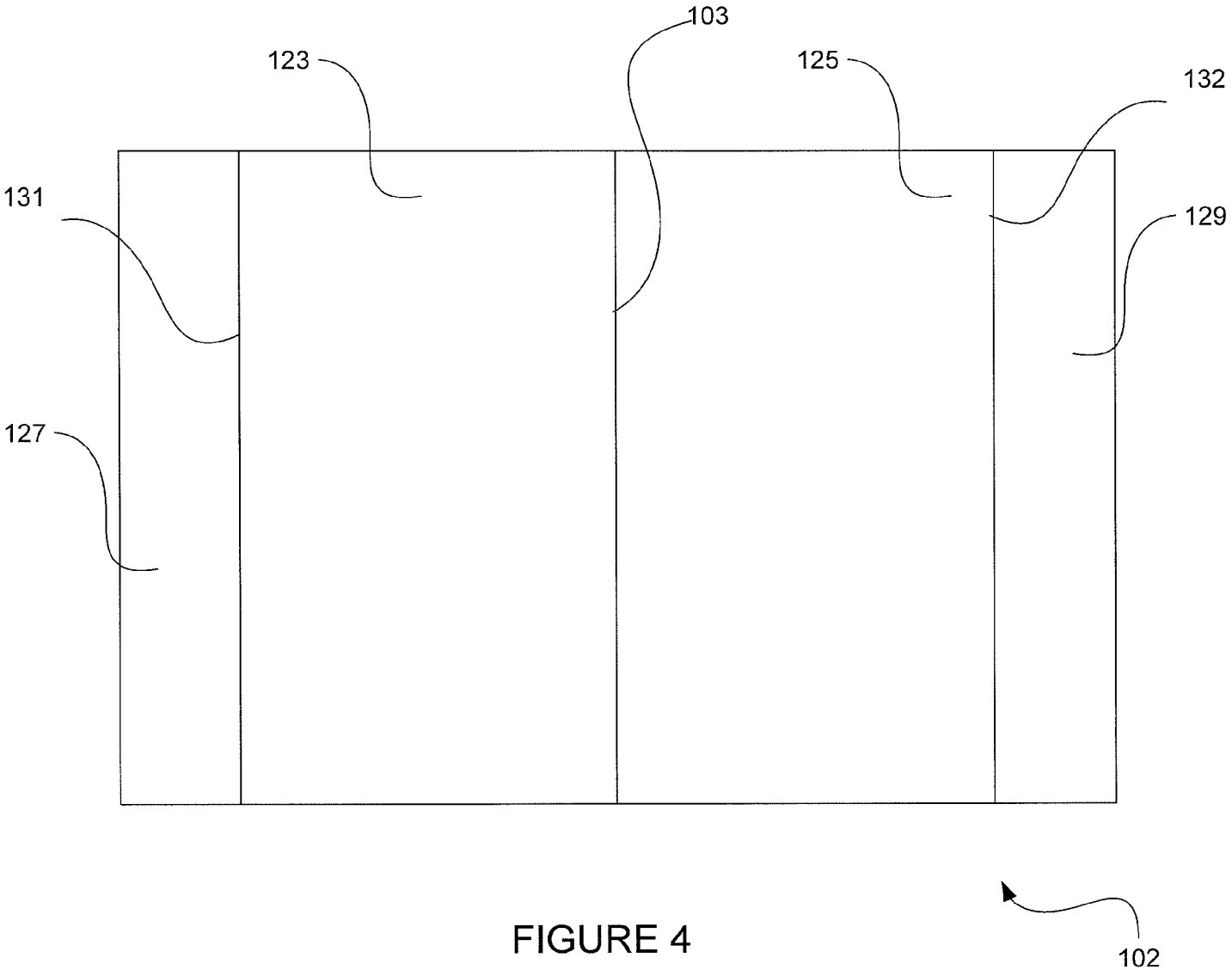
FIG. 4 illustrates an example of a supplementary blank used in manufacturing the container of the type illustrated in FIG. 1.

FIG. 4 illustrates an example of the supplementary blank 102 used in manufacturing the container of the type illustrated in FIG. 1. The supplementary blank 102 includes two major panels 123, 125 as well as two adjacent attachment panels 127, 129. As shown in FIG. 4, a first attachment panel 127 shares a fold line 131 with the neighboring major panel 123. Likewise, a second attachment panel 129 shares a fold line 132 with the neighboring major panel 125. Likewise, the two major panels 123, 125 share the fold line 103, which forms the apex of the V-shape of each end support following final assembly of the container.

Figure 5:
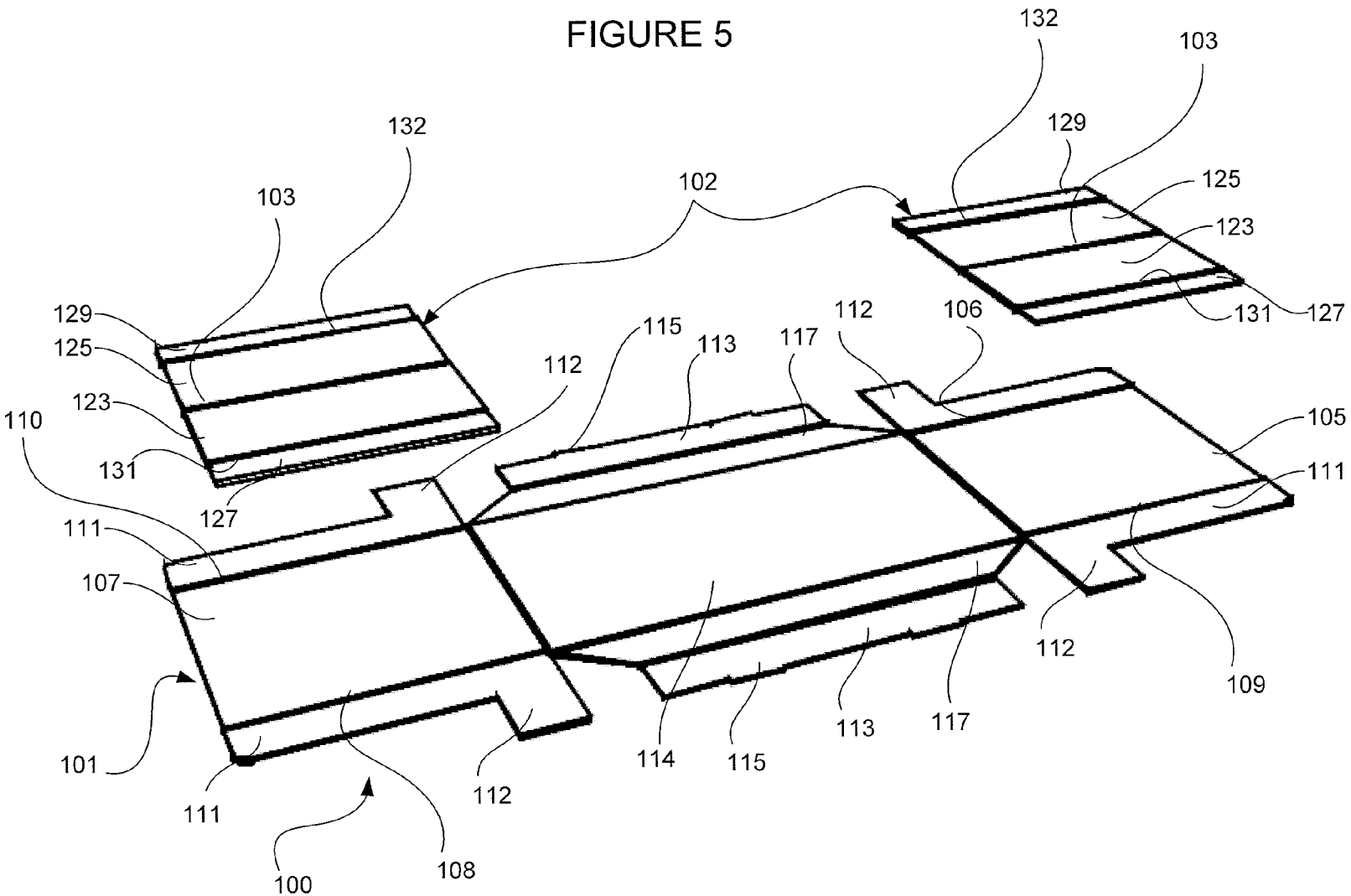
FIG. 5 illustrates both the primary and supplementary blanks illustrated in FIGS. 3-4 unassembled and used to provide the container illustrated in FIG. 1.

FIG. 5 illustrates the relative placement of the primary and supplementary blanks illustrated in FIGS. 3 and 4 with respect to each other to provide a preassembly as illustrated in FIGS. 6-9 and the container illustrated in FIGS. 1-2. As illustrated in FIG. 5, the primary and supplementary blanks 101, 102 may be configured so as to interact in a manner that enables the end supports to be formed easily and quickly as part of the final assembly of the container 100 from a corresponding preassembly (also referred to, for convenience, as preassembly 100). Accordingly, the dimensions for the blanks 101, 102 and their constituent panels, walls and sections may be selected so as to facilitate the positioning of the supplementary blanks 102 with respect to the primary blank 101 as illustrated in FIG. 5. The relative dimensions of certain panels of the primary and supplementary blanks 101, 102 are discussed further with reference to FIGS. 7-8.

As will be appreciated from the remaining disclosure by one of ordinary skill in the art, the container 100 may be used to ship, store or display product therein in a retail environment. Thus, subsequent to arrival at a retail environment or off-site fulfillment or contract packaging facility, a knockdown version of the container 100 (i.e., preassembly 100) may be finally assembled and product placed in the container 100 for transport and/or display. Therefore, it should be appreciated that, as a first operation in manufacturing the preassembly for the container 100, the faces of the primary and supplementary blanks 101, 102 are affixed together at various locations.

Figure 6:
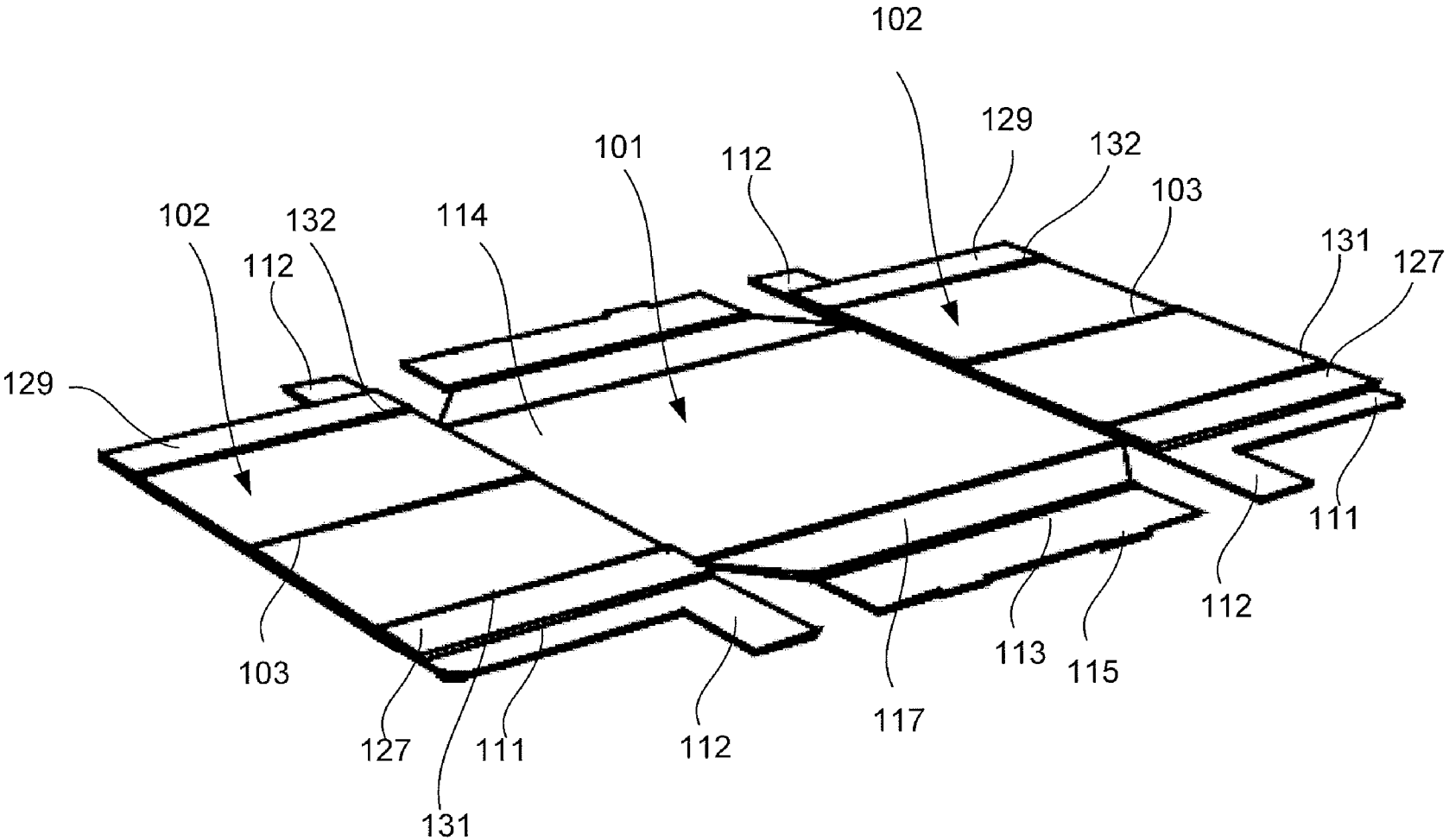
FIG. 6 illustrates a side perspective of the preassembly manufactured from the blanks illustrated in FIG. 5.

Thus, as shown in FIG. 6, a preassembly 100 may be provided wherein the primary and supplementary blanks 101, 102 are adhered to one another via adhesive but the panels, walls, etc. are not configured for final assembly. As a result, a preassembly 100 is manufactured and may be delivered to a location for final assembly and placement of product; such a preassembly may be effectively and easily stacked with other preassemblies because such preassemblies are flat having not yet been built or finally assembled as shown in FIG. 1.

Thus, returning to the manufacture of the preassembly 100, one or more portions of the primary and supplementary blanks 101, 102 may be adhered to one another. This coupling may be made using, for example, adhesive such as glue, staples, tape, etc., so as to produce the preassembly, wherein the positioning of supplementary blank 102 in cooperation with primary blank 101 is controlled.

More specifically, each of the fold lines 131, 132 on each supplementary blank 102 may be positioned parallel to but offset from a corresponding fold line on the primary blank 101. As explained in more detail with reference to FIGS. 7 and 9, the fold lines 131, 132 of the supplementary blank 102 are positioned parallel to but spaced away from corresponding fold lines 106, 108, 109, 110 on the primary blank 101 to promote ease of final assembly, increase stacking strength and deter nesting of containers resulting from poor stacking strength.

Thus, the fold line 132 on a first supplementary blank 102 corresponds to but is spaced apart from the fold line 106 between the first end panel 105 and a first side panel 111.

Likewise, the fold line 131 on first supplementary blank 102 corresponds to but is spaced apart from the fold line 109 between the first end panel 105 and a second side panel 111. Further, fold line 131 on a second supplementary blank 102 corresponds to but is spaced apart from fold line 108 between the second end panel 107 and a first side panel 111. Likewise, the fold line 132 on the second supplementary blank 102 corresponds to but is spaced apart from the fold line 110 between the second end panel 107 and a second side panel. Thus, the fold lines of the supplementary blanks 102 and the corresponding fold lines on the primary blank 101 are positioned parallel to one another but spaced away from each other.

Thus, as shown in FIG. 6, the primary and supplementary blanks 101, 102 may be adhered to each other where the attachment panels 127, 129 of the supplementary blank 102 meet mating portions of the corresponding side panels 111 of the primary blank 101. Adhesive may be applied to attachment panels 127, 129 of each of the supplementary blanks 102 and/or portions of the corresponding side panels 111 of the primary blank 102. Subsequently, the attachment panels 127, 129 of each of the supplementary blanks 102 may be placed in contact with corresponding portions of the side panels 111 of the primary blank 101 to promote adherence therebetween. Accordingly, it should be understood that adhesive may be applied on the top surfaces of the side panels 111 of the primary blank 101 or on bottom surfaces of the attachment panels 127, 129 of each of the supplementary blanks 102. Thus, as shown in FIG. 7, an adhesive 122 may be applied to either the top surfaces of the side panels 111 of the primary blank 101 or on bottom surfaces of the attachment panels 127, 129.

Figure 7:
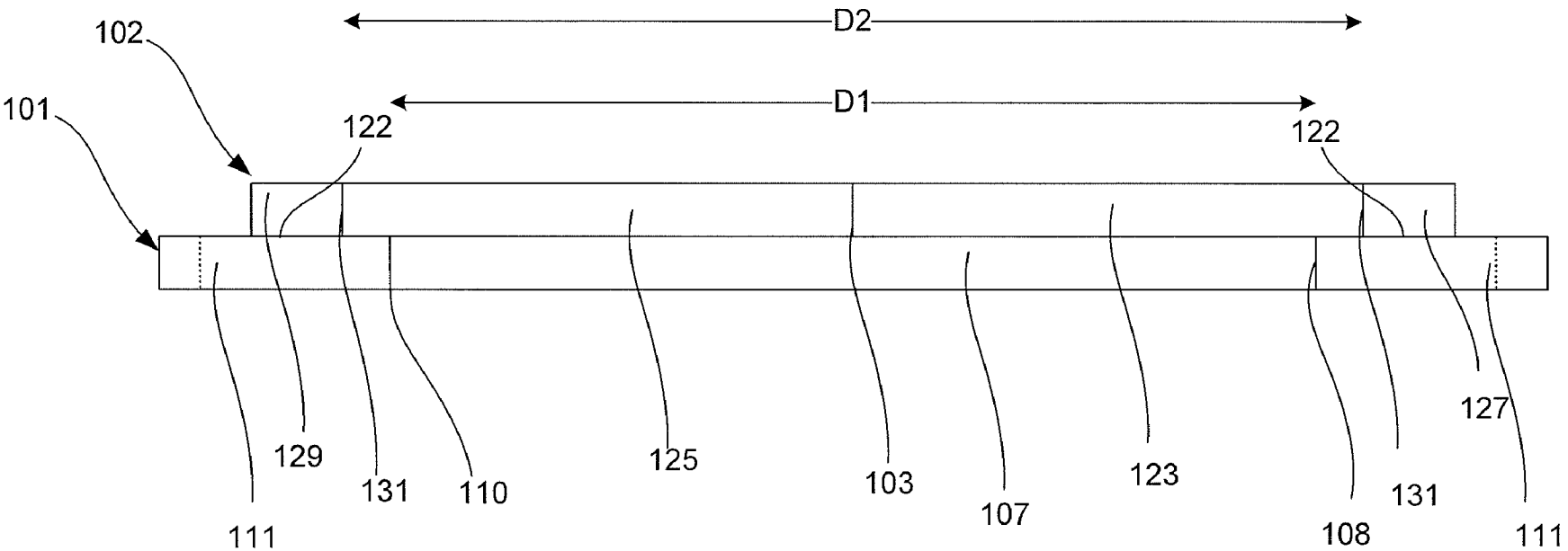
FIG. 7 illustrates an end view of the preassembly illustrated in FIG. 6.

The relationship between the fold lines of the primary and supplementary blanks 101, 102 may be more clearly understood with reference to FIG. 7. As shown in FIG. 7, the offset of the fold lines of the first and supplementary blanks 101, 102 enables the preassembly 100 to be flat for shipping to a final assembly location as well as being simply assembled to provide the end supports during final assembly. More specifically, as shown in FIG. 7, the total width D1 of the end panel 107 (or end panel 105) is less than the total width D2 of the combined major panels 123, 125 of the supplementary blank 102. This difference in widths is what enables the simple formation of the V-shaped end support during final assembly of the container 100, as described herein with reference to FIGS. 8-9.

As a result of this positioning and affixing of the primary and supplementary blanks 101, 102 described with reference to FIGS. 5-7, a preassembly 100 may be provided which, when utilized, results in a container 100 having an interior formed by the primary blank 101 serving as an exterior of the container 100. The interior includes a plurality of end supports each formed by the supplementary blanks 102 and positioned at opposing ends of the container interior, wherein the plurality of end supports are formed as part of the set up or final assembly of exterior of the container 100.

Figure 8:
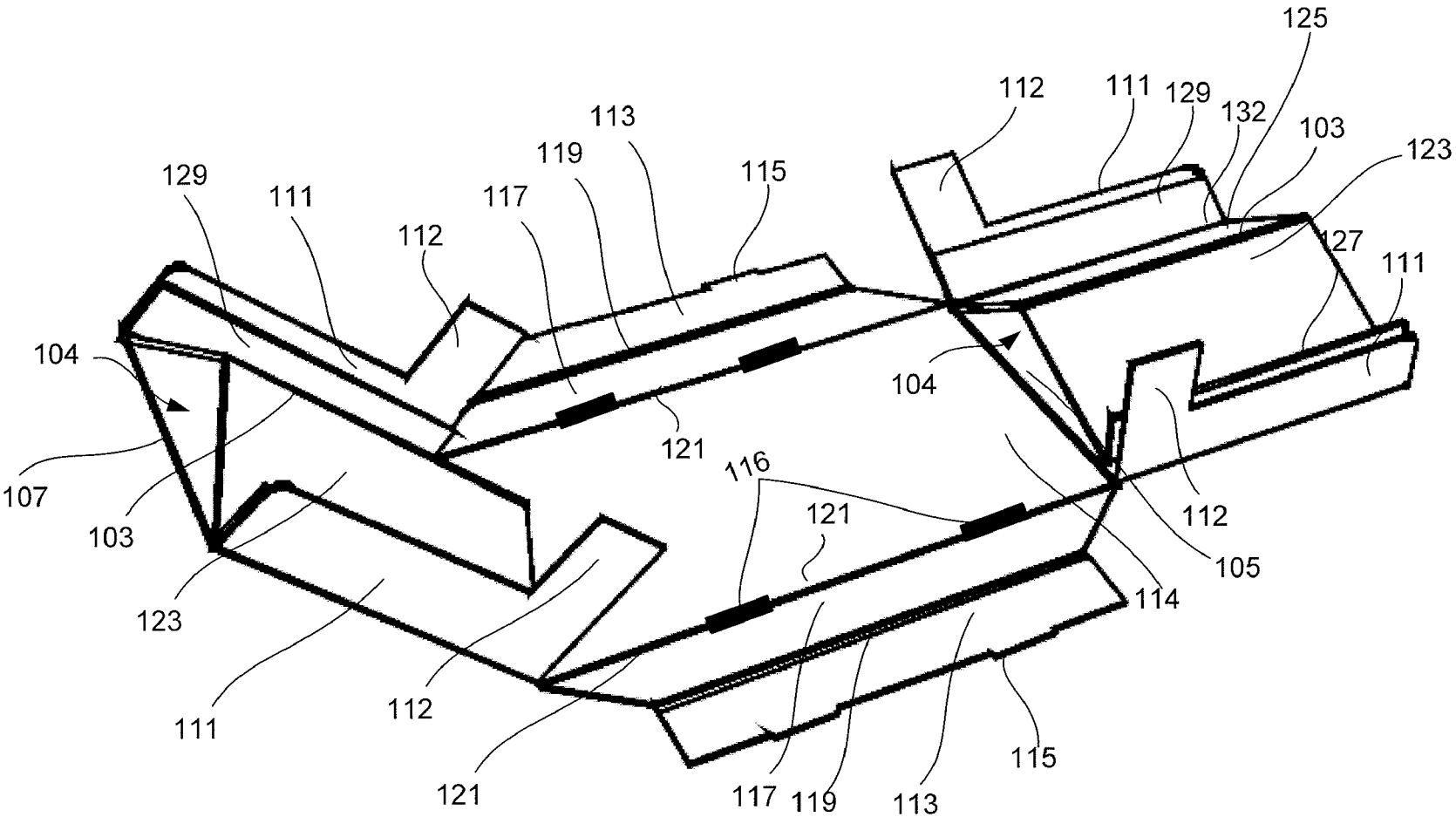
FIG. 8 illustrates a side perspective of the preassembly illustrated in FIG. 6 during a stage of final assembly.

FIG. 8 illustrates a side perspective of the preassembly illustrated in FIG. 6 during final assembly. As shown in FIG. 8, the first and second end panels 105, 107 are folded towards the bottom panel 114 along the fold lines that connect the end panels 105, 107 to the bottom panel 114 so as to begin to form ends of the container 100. Additionally, as best understood with reference also to FIG. 5, the side panels 111 are folded inwardly towards the respective end panels 105, 107 along their respective fold lines (e.g., 106, 109 for end panel 105 and 108, 110 for end panel 107) to begin to form portions of the sides of the container 111. As the region 112 of each side panel 111 meets the fold line 121, the first and second rollover panels are folded along fold line 121 towards the bottom panel 114. Subsequently, the first rollover panel 113 is folded towards the second rollover panel 117 along the fold line 119 to trap the regions 112 of the side panels 111 therebetween. The tabs 115 on the first rollover panel 113 are then inserted in the corresponding slots 116 on the fold line 121 to secure the regions 112 between the rollover panels 113, 117.

When the side panels 111 are folded inwardly towards the end panels 105, 107, the two major panels 123, 125 of the supplementary blank 102 are forced to fold relative to each other along fold line 103 because the two major panels 123, 125 together have a dimension D2, which is greater than the corresponding width D1 of each of the end panels 105, 107. As a result of this size difference, the two major panels 123, 125 of the supplementary panel are forced to form the corresponding V-shaped end support. Therefore, as the two side panels 111 adjacent to each of the end panels 105, 107 are folded inwardly towards the end panel (105 or 107), the corresponding end support is produced from the major panels 123, 125 folded with respect to one another along the apex fold line 103.

It should be appreciated that, the folding of the major panels 123, 125 along the fold line 103 may be automatic as a result of the assembly of the primary blank 101 or it may be facilitated by some additional force on the major panels 123, 125 away from the corresponding end panel 105 or 107 to ensure that the major panels 123, 125 fold properly along the fold line 103. Such facilitation may have particular utility if, for example, one or both of the supplementary blanks 102 are configured such that the end supports formed in the container have a configuration other than a V-shaped support. For example, there may be more than two major panels (e.g., 123, 125) in the supplementary blank 102; as a result, more than one fold line may be included between the major panels. In such an situation an end support may actually be shaped more like a "U" than a "V." In such an implementation, a median region of shortened width dimension $W_m$ (as shown in FIG. 2) may still be provided to deter against product movement; further, the end supports would still provide improved stackability.

It should also be understood that, in accordance with at least one embodiment, the major panels 123, 125 need not be the same width as one another. Therefore, a container may be provided that includes a median region of shortened width $W_m$ nearer or farther away from what may be considered a front or back side of the container.

Figure 9:
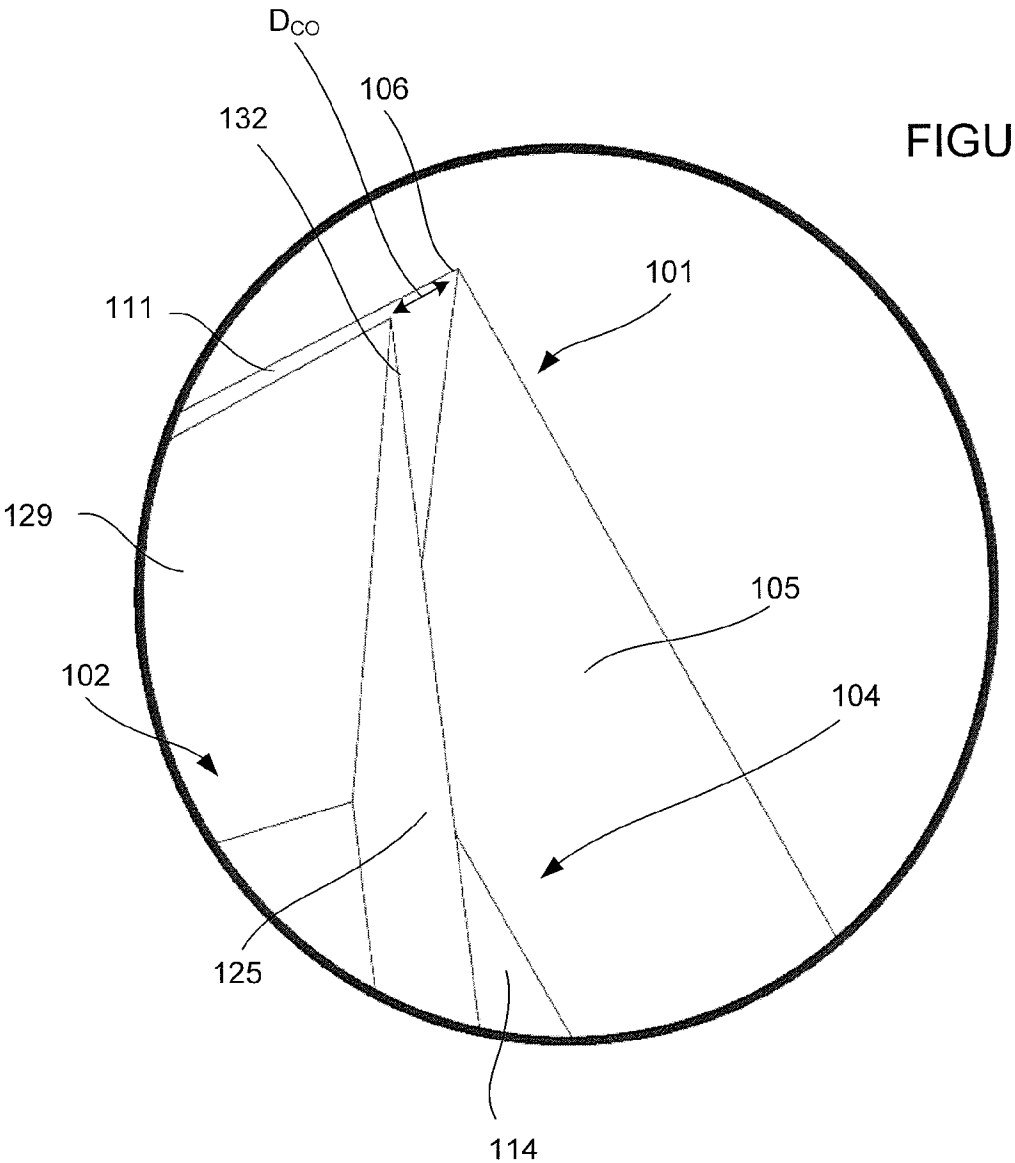
FIG. 9 illustrates an enlarged view of the interconnectedness between a primary blank and a supplementary blank utilized in an illustrated embodiment after assembly.

FIG. 9 illustrates an enlarged view of the interaction between the side panel 111 and end panel 105 of the primary blank 101 and the attachment panel 127 of the supplementary blank 102. It should be appreciated that this enlarged view is of one of the corners of the container 100 but is illustrative of the positioning of each of the corners. As explained briefly above, and as shown in FIGS. 7-9, the sizing and placement of the attachment panel 129 may be such that a corner offset width $D_{co}$ (see FIG. 9) exists between the location of the fold line 132 of the supplementary blank 102 and the corresponding fold line 106 of the primary blank 101. To best understand the relative dimensions of the panels of the container, it should be appreciated that the width dimension D2 (total combined width of major panels 123, 125 of the supplementary blank 102) is approximately equal to the width dimension D11 (the width of each of the end panels 105, 107) plus twice the corner offset width $D_{co}$. This sizing enables the folding of the side panels 111 of the primary blank 101 to facilitate formation of the corresponding ends supports without appreciably increasing the number of touches necessary to finally assemble the container 100 relative to the number of touches necessary for final assembly of a container without such end supports.

Figure 10:
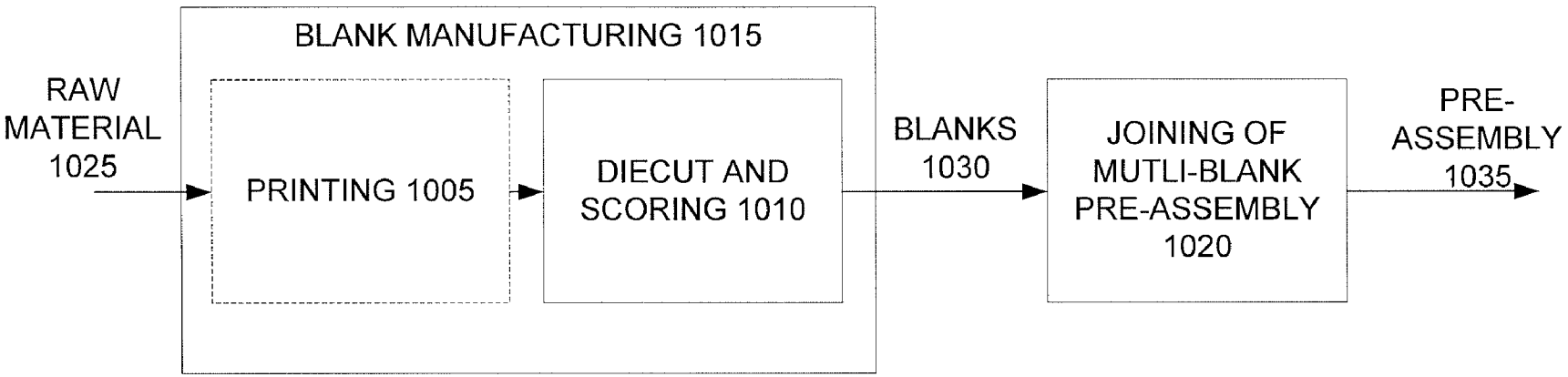
FIG. 10 illustrates a functional block diagram used to describe a method of manufacturing containers in accordance with an illustrated embodiment.

With this understanding of the utility of the invention in mind, FIG. 10 illustrates a functional block diagram used to describe the manufacturing method of containers in accordance with an illustrated embodiment. As alluded to in the background section, and as conventionally known, the manner of manufacturing containers such as the examples illustrated in FIGS. 1-9 may be conveniently described in two phases: preassembly and final assembly/use.

Preassembly manufacture, as described in connection with FIGS. 3-7, is normally performed at a container manufacturing facility to produce a preassembly which may also be thought of and referred to as a knockdown of the container. These preassemblies may be shipped to a customer location such as a product manufacturing facility or retail environment or third party fulfillment contract packaging facility. At that destination, the container customer may perform final assembly (as described in connection with FIGS. 8-9) of the containers by, for example, folding and assembling various panels of the container to provide a container that is configured to hold manufacture product, e.g., for shipping and/or display.

The manufacturing of the container preassemblies may be performed by the customer of the preassemblies and/or as part of manufacture of the preassemblies as illustrated in FIG. 10. FIG. 10 illustrates various functional operations performed as part of the manufacture of a preassembly by, for example, a display, shipping or display ready packaging manufacturer. The operations may begin, for example, with printing 1005 of container material prior to the container material being die cut and/or scored 1010 as part of an overall blank manufacturing operation 1015. The manufactured blanks 1030 may or may not be printed on one or both sides of the blanks 1030 depending on customer requirements. Accordingly, the printing operation 1005 may be omitted.

Subsequent to blank manufacturing 1015, the manufactured blanks may be affixed to one another as part of the joining of multi-blank preassembly operations 1020. The operations performed at 1020 may be performed in various suitable manners including by hand or using various commercially available machines (for example, those produced by Bahmueller Technologies, Inc. of Charlotte, NC., USA or Bobst Group North America of Roseland, NJ., USA). Thus, the operations performed at 1020 may produce preassemblies for containers such as that illustrated in FIG. 1.

Therefore, it should be appreciated that one or more of the operations performed to produce blanks, preassemblies, knockdowns and containers may be performed in whole or in part by machines and or human personnel. Moreover, human personnel may utilize one or more different types of machines and/or tools to perform assembly operations performed either to manufacture preassemblies or finally assembled containers.

Thus, at the beginning of such operations, raw material 1025 is used to produce blanks 1030. Such raw materials 1025 may include but are not limited to various grades, types, configurations and combinations of corrugated fiberboard and/or solid paperboard, liner board, board of various fluting types and combinations as well as various types of sealants, non-organic materials and inks and dies of various suitable types.

It should be understood that implementation of the method and system of the present invention involves performing or completing certain selected tasks or steps manually, automatically, or a combination thereof.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

For example, various illustrated features of the preassembly and resulting containers may be omitted. Furthermore, it should be understood that invention embodiments are capable of variations practiced or carried out in various ways. Therefore, it should be appreciated that, in accordance with at least one embodiment of the invention, any and all of the walls may be constructed of corrugated cardboard. However, it should be understood that the walls, panels, any tabs on various panels, etc., may be constructed of various industry recognized appropriate materials that meet various transporting and/or display criteria. As a result, it should be understood that containers manufactured in accordance with at least one embodiment of the invention may also be considered "cartons," which may be considered packaging or display containers, commonly made from cardstock or cardboard. Further, it should be understood that cartons come in many different varieties but most cartons can be folded and assembled from a flat form, known as a carton blank. Thus, it should be understood that the pattern for any blank, preassembly or container may be different than those described herein.

Alternatively, or more specifically, the packaging and/or display containers may be made using corrugated board, e.g., material made by a corrugator (a machine that produces corrugated board by attaching fluting to liners) which is a structured board formed by gluing one or more arched layers of corrugated medium to one or more flat-facing linerboards.

Additionally, it should be appreciated that material used in accordance with at least one embodiment of the invention may be laminated to provide barrier properties. Further, other barrier materials may be used including Ultra Violet (UV), moisture and gas barriers. Additionally, though not discussed in detail herein, it should be understood that any adhesive used to provide a bond between materials used in containers provided in accordance with the invention may include any substance that helps bond two materials together, examples including but not limited to glue and paste.

Further, it should be appreciated that the material used to form the primary blank may be different, stronger, or weaker than the blank used to form the supplementary blank. Thus, for example, use of a supplementary blank that is of a heavier, more durable or stronger material than the material used for primary blank, may provide the increased ease of final assembly as well as increased durability or strength to the resulting container while reducing the amount of material in the container (something of interest for environmental and cost issues).

It should also be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Additionally, it should be understood that the functionality described in connection with various described components of various invention embodiments may be combined or separated from one another in such a way that the structure of the invention is somewhat different than what is expressly disclosed herein.

Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

As a result, it will be apparent for those skilled in the art that the illustrative embodiments described are only examples and that various modifications can be made within the scope of the invention as defined in the appended claims.

The invention claimed is:

1. A container preassembly comprising:

a primary blank including a plurality of lateral panels configured to provide an exterior of the container; and a plurality of supplementary blanks each including a plurality of major panels extending between a pair of attachment panels, wherein each of the pair of attachment panels of each of the plurality of the supplementary blanks is affixed to a first and a second of the lateral panels that are opposed to one another such that, as the container is assembled, each of a plurality of supports is formed proximate to a third lateral panel located between the first and second opposed lateral panels when the first and second opposed lateral panels corresponding to the third lateral panel are folded relative to the third lateral panel, wherein, following final assembly, the plurality of major panels of each supplementary blank constitute the lateral support proximate to the corresponding third lateral panel, wherein the plurality of major panels of each supplementary blank are configured to form support forms a V-shaped end support following final assembly, the end support having an apex along a fold line located between the plurality of major panels.

2. The preassembly of claim 1, wherein the primary blank includes a plurality of pairs of rollover panels, each pair of rollover panels being configured to be folded upon themselves during final assembly of the container so as to trap a region of each of two of the lateral panels adjacent to one another therebetween to form one of the lateral panels of the container.

3. The preassembly of claim 1, wherein each of the pair of attachment panels of each of the plurality of supplementary blanks is glued to a corresponding one of the lateral panels of the primary blank.

4. The preassembly of claim 1, wherein the primary blank further comprises a bottom panel extending between the two opposing first and second lateral panels of the primary blank.

5. The preassembly of claim 1, wherein the container is a flat bottomed tray container.

6. A container preassembly comprising:

a primary blank including a plurality of lateral panels configured to provide an exterior of the container; and a plurality of supplementary blanks each including a plurality of major panels extending between a pair of attachment panels, wherein each of the pair of attachment panels of each of the plurality of the supplementary blanks is affixed to a first and a second of the lateral panels that are opposed to one another such that, as the container is assembled, each of a plurality of supports is formed proximate to a third lateral panel located between the first and second opposed lateral panels when the first and second a opposed lateral panels corresponding to the third lateral panel are folded relative to the third lateral panel, and wherein, following final assembly, the plurality of major panels of each supplementary blank constitute the lateral support proximate to the corresponding third lateral panel, wherein the width of the combination of the major panels of each supplementary blank is equal to the width of the corresponding third lateral panel plus two times a corner offset width, which is the distance between a corner partially formed by the corresponding third lateral panel and a fold line included in the supplementary blank between one of the major panels and the neighboring attachment panel.

7. A plurality of blanks for a container preassembly, the plurality of blanks comprising:

a primary blank including a plurality of lateral panels configured to provide an exterior of the container; and a plurality of supplementary blanks each including a plurality of major panels extending between a pair of attachment panels, wherein the primary blank is configured to mate with and be affixed with the supplementary blanks so that each of the pair of attachment panels of each of the plurality of supplementary blanks is affixed to a first and a second of the lateral panels that are opposed to one another such that, as the container is assembled, each of a plurality of supports is formed proximate to a third of the lateral panels located between the first and second lateral panels when the first and second lateral panels corresponding to the third lateral panel are folded relative to the third lateral panel, wherein, following final assembly, the plurality of major panels of each supplementary blank constitute the support proximate to the corresponding third lateral panel, and wherein the plurality of supports form V-shaped end supports following final assembly of the container, the end supports having an apex along a fold line located between the plurality of major panels.

8. The plurality of blanks of claim 7, wherein the primary blank includes a plurality of pairs of rollover panels, each pair of rollover panels being configured to be folded upon themselves during final assembly of the container so as to trap a region of each of two of the lateral panels adjacent to one another therebetween to form one of the lateral panels of the container.

9. The plurality of blanks of claim 7, wherein each of the pair of attachment panels of each of the plurality of supplementary blanks is configured to mate with and be glued to a corresponding one of the lateral panels of the primary blank.

10. The plurality of blanks of claim 7, wherein the primary blank further comprises a bottom panel extending between the two opposing first and second lateral panels.

11. The plurality of blanks of claim 7, wherein the container is a flat bottomed tray container.

12. A plurality of blanks for a container preassembly, the plurality of blanks comprising:

a primary blank including a plurality of side panels and end lateral panels configured to provide an exterior of the container; and plurality of supplementary blanks each including a plurality of major panels extending between a pair of attachment panels, wherein the primary blank is configured to mate with and be affixed with the supplementary blanks so that each of the pair of attachment panels of each of the plurality of supplementary blanks is affixed to corresponding side a first and second of the lateral panels of the primary blank that are opposed to one another such that, as the container is assembled, each of a plurality of end supports is formed proximate to a corresponding end a third of the lateral panel panels of the primary blank located between the first and second lateral panels when the side first and second lateral panels corresponding to that end the third lateral panel are folded relative to that end the third lateral panel, wherein, following final assembly, the plurality of major panels of each supplementary blank constitute the end support proximate to the corresponding end third lateral panel, and wherein the width of the combination of the major panels of each supplementary blank is equal to the width of the corresponding third lateral panel plus two times a corner offset width, which is the distance between a corner partially formed by the corresponding third lateral panel and a fold line included in the supplementary blank between one of the major panels and the neighboring attachment panel.

13. A method of manufacturing a container, the method comprising:

cutting a primary blank including a plurality of lateral panels configured to provide an exterior of the container;

cutting a plurality of supplementary blanks each including a plurality of major panels extending between a pair of attachment panels;

affixing each of the pair of attachment panels of each of the plurality of supplementary blanks to a first and a second of the lateral panels that are opposed to one another such that, as the container is assembled, each of a plurality of supports is formed proximate to a third of the lateral panels located between the first and second opposed lateral panels when the first and second opposed lateral panels corresponding to the third lateral panel are folded relative to the third lateral panel, wherein, following final assembly, the plurality of major panels of each supplementary blank constitute the support proximate to the corresponding third lateral panel; and wherein the plurality of supports form V-shaped supports with an apex along a fold line located between the plurality of major panels.

14. The method of claim 13, wherein the primary blank includes a plurality of pairs of rollover panels, each pair of rollover panels being configured to be folded upon themselves and trap a region of each of two of the lateral panels adjacent to one another therebetween to form one of the lateral panels of the container.

15. The method of claim 13, wherein each of the pair of attachment panels of each of the plurality of supplementary blanks is glued to a corresponding one of the lateral panels of the primary blank.

16. A method of manufacturing a container, the method comprising:

cutting a primary blank including a plurality of lateral panels configured to provide an exterior of the container;

cutting a plurality of supplementary blanks each including a plurality of major panels extending between a pair of attachment panels;

affixing each of the pair of attachment panels of each of the plurality of supplementary blanks to a first and a second of the lateral panel that are opposed to one another such that the container is assembled, each of a plurality of supports is formed proximate to a third of the lateral panels located between the first and second opposed lateral panels when the first and second opposed lateral panels corresponding to the third lateral panel are folded relative to the third lateral panel, wherein following final assembly, the plurality of major panels of each supplementary blank constitute the support proximate to the corresponding third lateral panel; and wherein the width of the combination of the major panels of each supplementary blank is equal to the width of the corresponding third lateral panel plus two times a corner offset width, which is the distance between a corner partially formed by the corresponding third lateral panel and a fold line included in the supplementary blank between one of the major panels and the neighboring attachment panel.

17. The method of claim 13, wherein the primary blank further comprises a bottom panel extending between the two opposing first and second lateral panels of the primary blank.

18. The method of claim 13, wherein the container is a flat bottomed tray container.

* * * * *